United States Patent [19]

Roggenburg, Jr.

[11] Patent Number: 4,474,314

[45] Date of Patent: Oct. 2, 1984

[54] SQUEEZE BOTTLE SELF-CLOSING VISCOUS LIQUID DISPENSING VALVE HAVING MANUALLY OPERATED POSITIVE SHUT-OFF

[75] Inventor: Stanley L. Roggenburg, Jr., Staten Island, N.Y.

[73] Assignee: Essex Chemical Corporation, NJ

[21] Appl. No.: 393,312

[22] Filed: Jun. 29, 1982

[51] Int. Cl.[3] ..... B05B 11/04

[52] U.S. Cl. ..... 222/494; 222/147; 222/153; 222/484; 222/496; 222/521

[58] Field of Search ..... 222/147, 491, 492, 493, 222/494, 495, 496, 498, 499, 520, 525, 549, 478, 153, 212, 213, 215, 481, 521, 482, 481.5, 484, 487

[56] References Cited

U.S. PATENT DOCUMENTS

| | | | |
|---|---|---|---|
| 2,188,184 | 1/1940 | Hogg | 222/482 |
| 2,368,836 | 2/1945 | Holwick | 222/147 |
| 2,711,271 | 6/1955 | Schlicksupp | 222/521 X |
| 3,384,276 | 5/1968 | Henningfield | 222/484 X |
| 3,412,910 | 11/1968 | Hahn | 222/494 |
| 4,061,254 | 12/1977 | Nilson | 222/499 X |
| 4,065,037 | 12/1977 | Haller | 222/153 |
| 4,141,475 | 2/1979 | Nilson | 222/494 |
| 4,226,342 | 10/1980 | Laauwe et al. | 222/494 |
| 4,239,123 | 12/1980 | Mueller et al. | 222/491 |

*Primary Examiner*—Joseph J. Rolla
*Assistant Examiner*—Kevin P. Shaver
*Attorney, Agent, or Firm*—Kenyon & Kenyon

[57] ABSTRACT

A self-closing squeeze bottle dispensing valve includes a vent for venting the bottle after squeezing. The valve is made with a cap which can be rotated so as to positively shut-off not only the valve's dispensing orifice, but also its vent, the two shut-offs being simultaneous.

6 Claims, 17 Drawing Figures

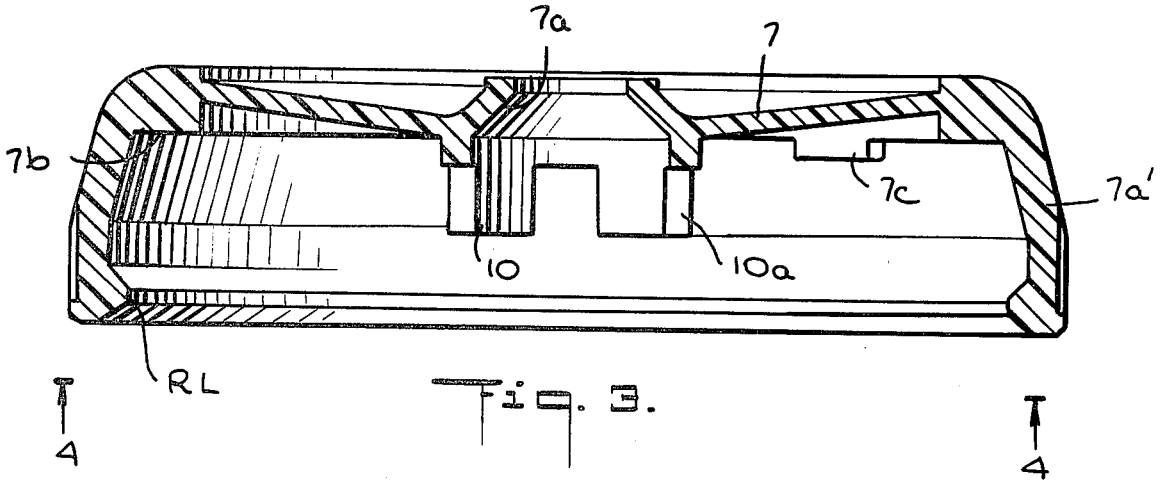
Fig. 3.
Fig. 4.
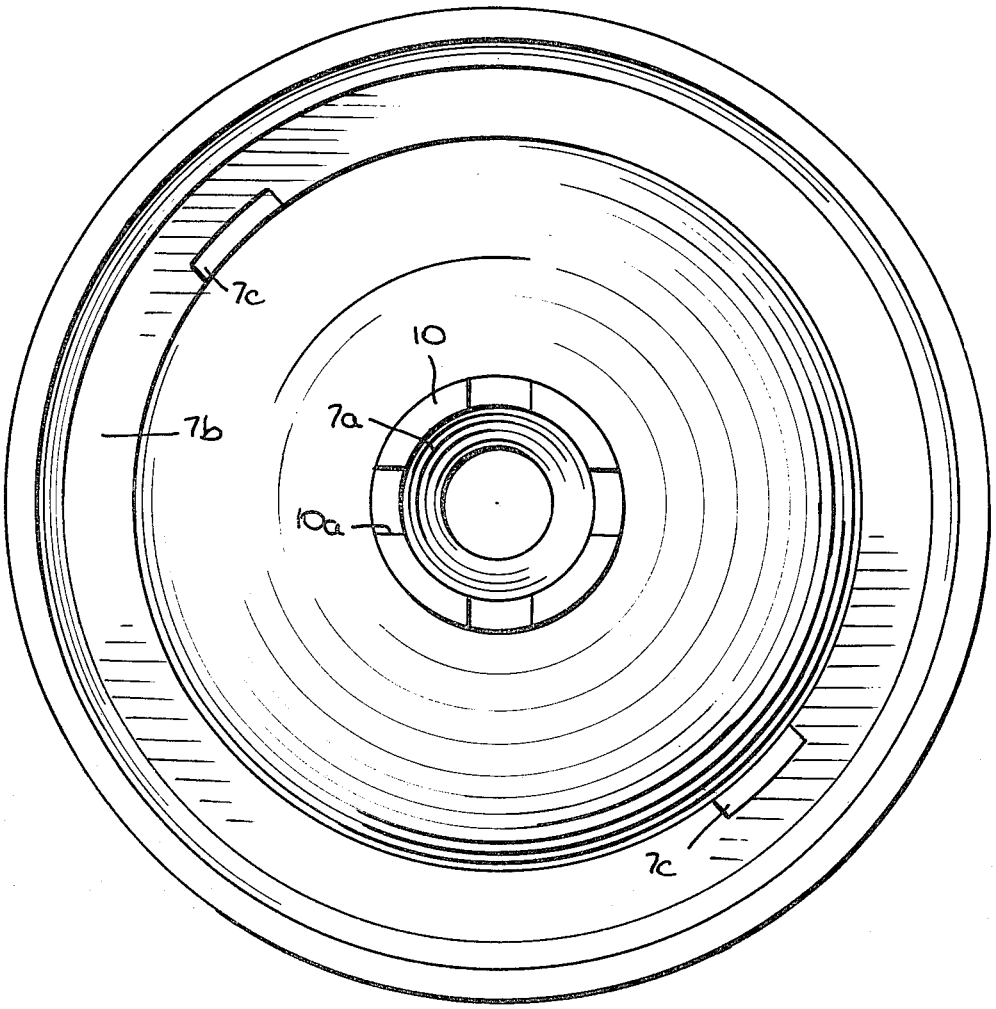

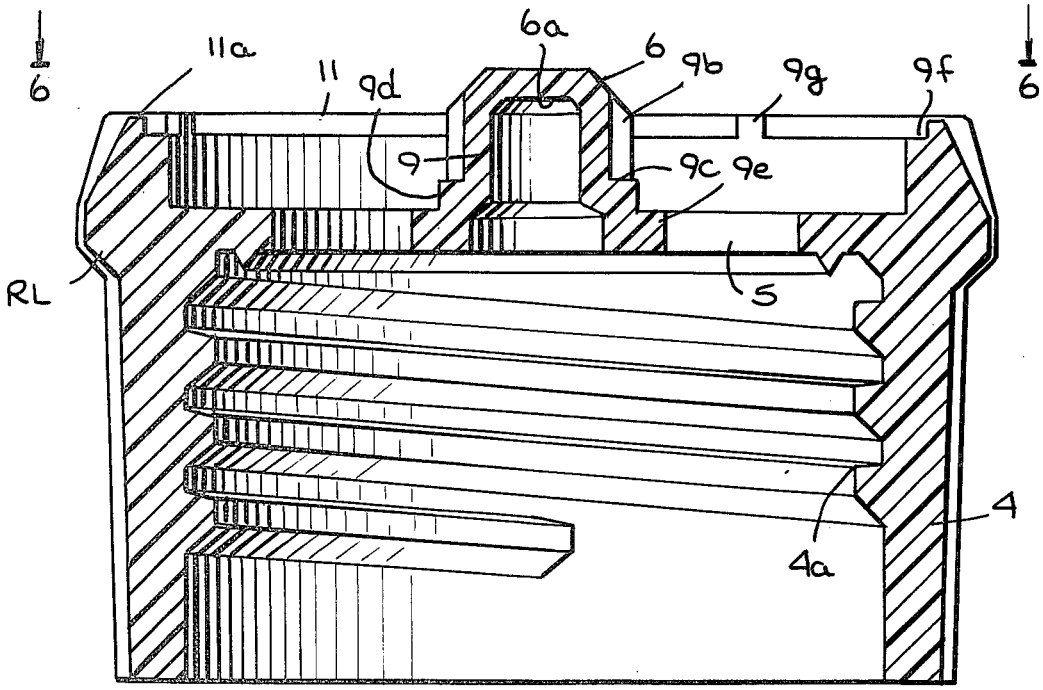
Fig. 5.
Fig. 6.
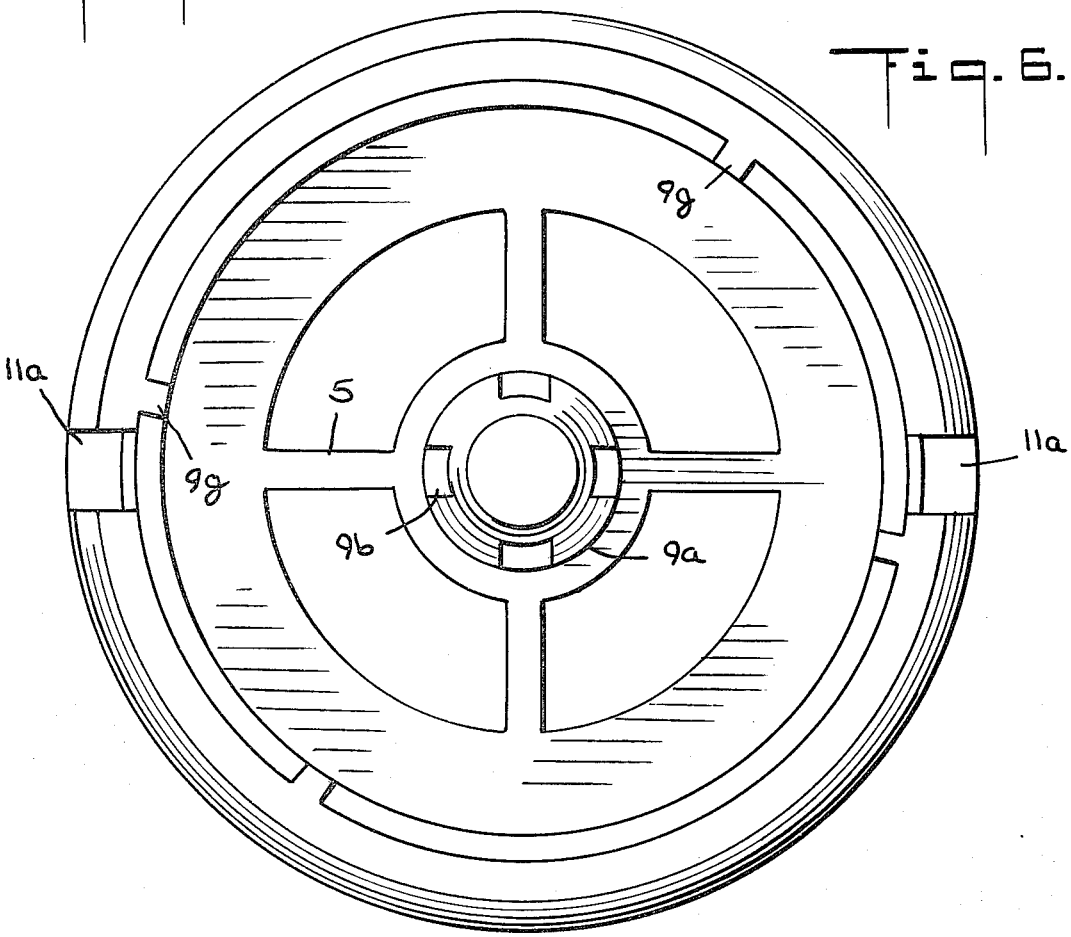

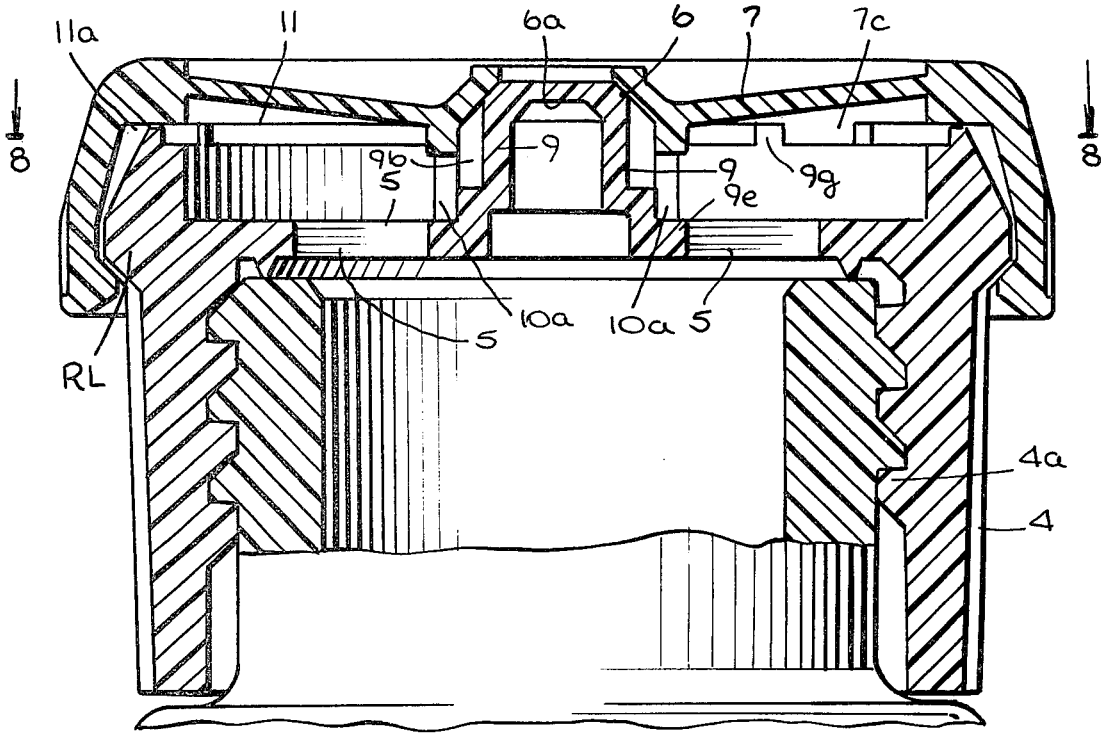
Fig. 7.
Fig. 8.
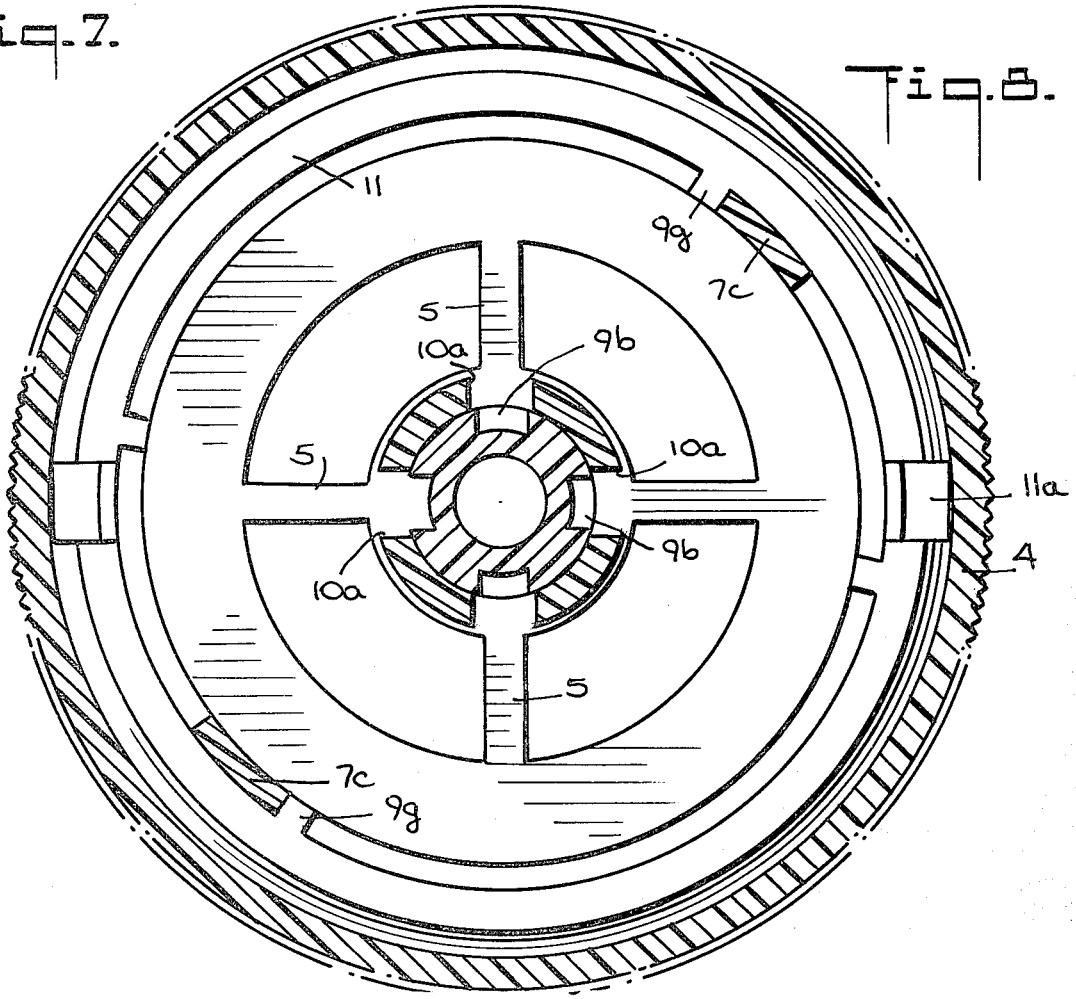

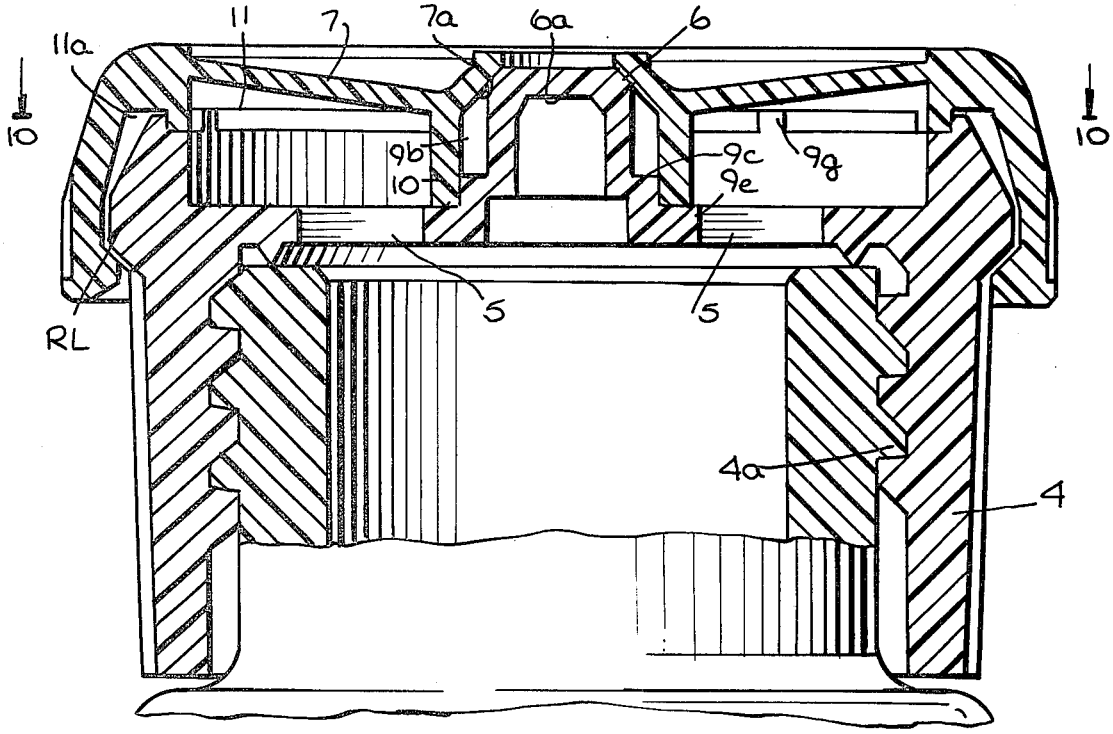
Fig. 9.
Fig. 10.
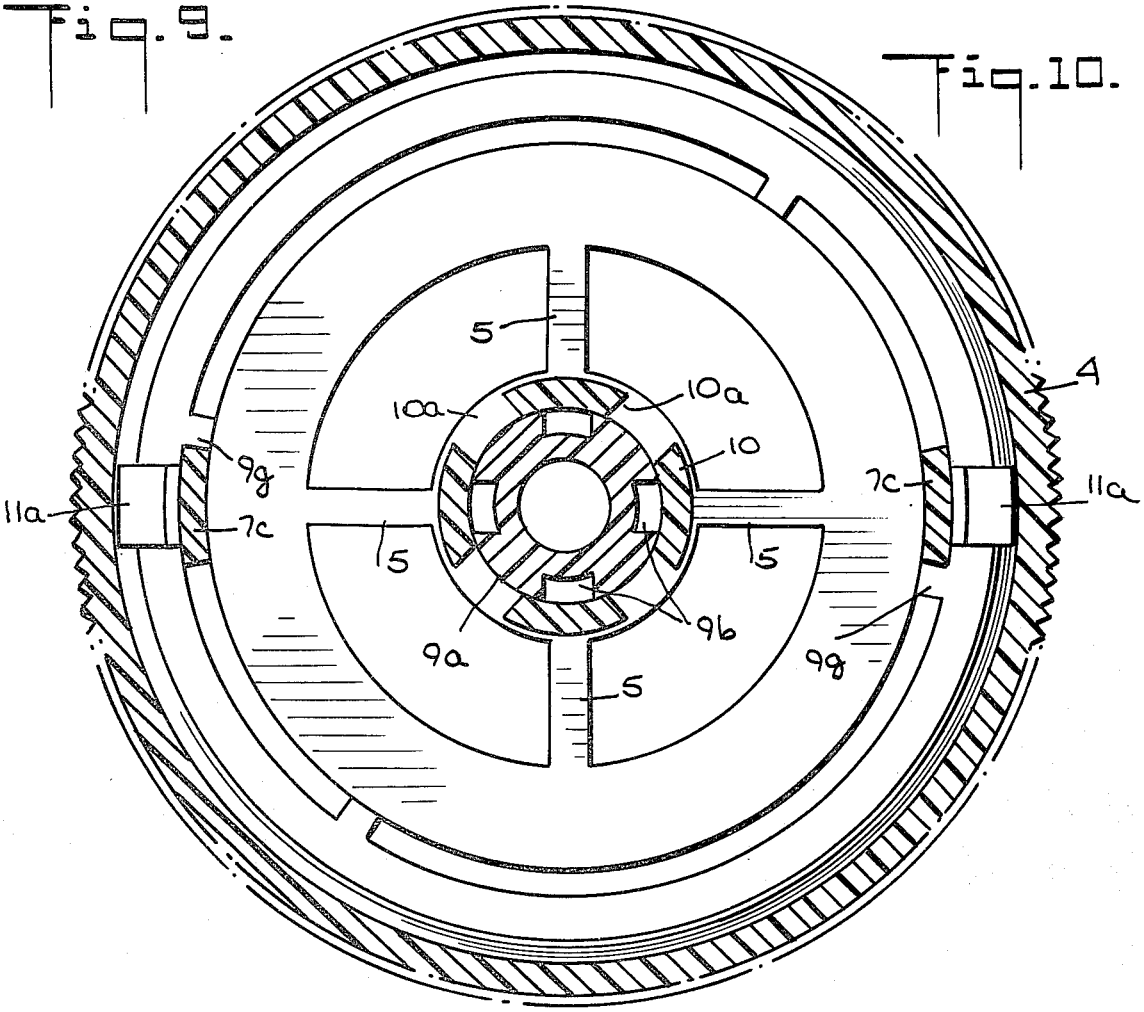

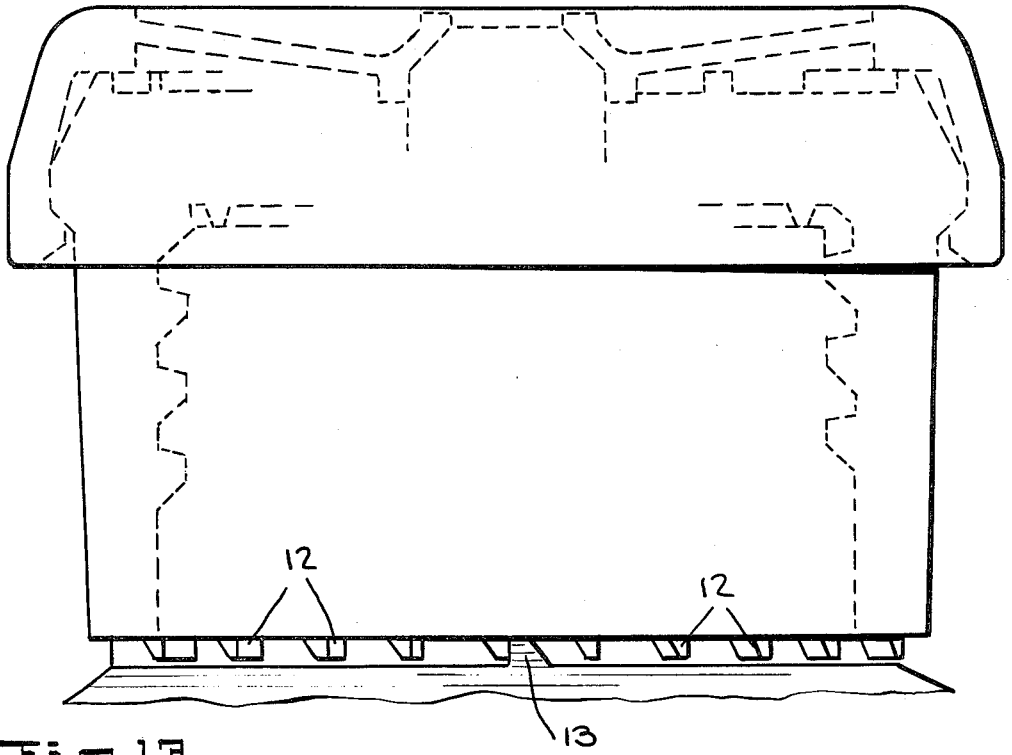
Fig. 13.
Fig. 14.
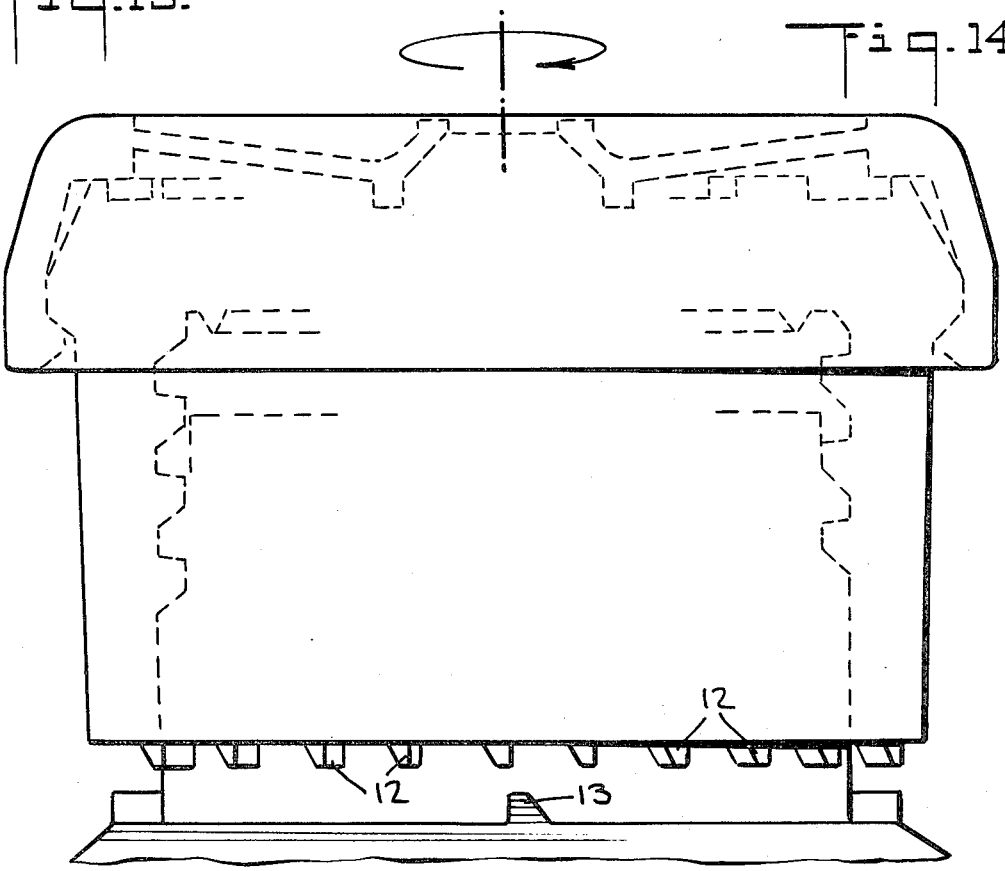

SQUEEZE BOTTLE SELF-CLOSING VISCOUS LIQUID DISPENSING VALVE HAVING MANUALLY OPERATED POSITIVE SHUT-OFF

There are many prior art suggestions concerning the design of a self-closing dispensing valve which can be applied to the mouth of a squeeze bottle, collapsible tube or the like containing a fluid product.

Characteristically such suggestions involve a stationary valve seat and an elastically flexible diaghragm having a hole with a periphery normally seating on the valve seat under the spring force of the diaphragm, fluid pressure on the inside of the diaphragm springing the diaphragm away from the valve seat for opening and release of the pressure permitting the diaphragm to spring back and close the valve.

For commercial production, any self-closing valve must be designed so it can be made with injection-molded plastic parts which can be easily assembled.

A commercially successful squeeze bottle, self-closing dispensing valve is disclosed by the Laauwe and Roggenburg U.S. Pat. No. 4,226,342. It is applied to squeeze bottles containing a viscous liquid product, exemplified by soft soap for personal use, and millions have been sold and used successfully.

This patented valve has a valve seat formed by the periphery of a thin wafer of comparatively small diameter, the elastic, flexible diaghragm hole having a thin periphery seating on the wafer's periphery, both thin peripheries having substantially mating conical surfaces, the entirety of these surfaces contacting each other when the valve is closed. The wafer is supported by radial spokes which connect with an annular base which is attached to the squeeze bottle's mouth, and the diaphragm is part of a cap having a depending flange which via a ring lock formation is snapped on the base to assemble the valve. The base and cap are each integral injection-molded plastic parts and the cap cannot be rotated on the base.

With the above construction, during the self-closing action, the viscous fluid product is squeezed easily from the two twin peripheries so that they reclose with a positive shut-off and only a relatively small pressure on the diaphragm is required for valve opening because the intermating conical peripheries are not wedged or frictionally held together when closed. To insure against wedging, the spokes adjacent to the periphery of the wafer and slightly therebelow form stops preventing excessive downward movement of the diaphragm, thus positively preventing the periphery of the diaphragm's hole from wedging downwardly on the wafer's periphery. The valve parts are designed to permit them to be molded with precision and the stops can be positioned so as to stop closing diaphragm motion just as the two conical peripheries intercontact under the spring closing force of the diaphragm. The wafer has a flat top and bottom, and excepting for its supporting spokes, its bottom is otherwise free from obstructions in a downward direction, the viscous fluid product being otherwise free from obstructions in a downward direction.

The valve is used commercially on hooked, squeeze bottles which can be hung with the valve upside down where it operates equally successfully as when upright.

Any self-closing squeeze bottle dispensing valve involves the problem that when the user packs the squeeze bottle having the valve, for example, in a suitcase, inadvertent squeezing of the squeeze bottle discharges the bottle's content. The prior art has made suggestions in connection with prior art self-closing valve constructions.

For example, the Schlecksupp U.S. Pat. No. 2,711,271 suggests the use of what is in effect a bayonet joint arrangement so that by manually turning an externally accessible part, the diaphragm can be rigidly locked against opening motion. This concept has the disadvantage that after being locked closed for a time, the cooperating plastic parts of any self-closing valve tend to acquire a set or substantially permanent deformation.

The concept of leaving the diaphragm free from rigid restraint and for a manual shut-off by preventing the fluid product from reaching and being extruded over the valve seat, is suggested by the Nilson U.S. Pat. No. 4,414,475. In this case the bottom of the diaphragm is completely closed off from the product in the squeeze bottle by the valve having a solid wall therebetween, a manually operated valve arrangement connecting the product with the space between the wall and the diaphragm. This leaves the valve parts free from rigid restraint, but the product pressurized when the squeeze bottle is squeezed, must travel a devious path requiring excessive pressure on the squeeze bottle. This U.S. Pat. No. 4,141,475 shows that to manually operate its positive shut-off, a cap is turned, the cap being rotatively connected to a part connected to the squeeze bottle.

A commercially acceptable self-closing valve must incorporate an air vent to permit reexpansion of the squeeze bottle after its squeezing. Such an air vent introduces the problem that even when having a manual positive shut-off, when a squeeze bottle having a self-closing vented valve is shipped or squeezed excessively, the bottle's content can escape via the vent.

The object of the present invention is to provide a squeeze bottle self-closing viscous liquid dispensing valve having a manually operated positive shut-off, and which retains the advantages of the valve of the Laauwe-Roggenburg patent. That is to say, the valve must be designed to permit its production in large quantities by the injection-molding technique, permit the use of the principles of the Laauwe and Roggenburg patent, and for positive shut-off must be manually controllable, preferably by turning the cap of that patented valve.

Briefly summarized, this invention includes the concept of the Laauwe and Roggenburg patent wherein the spokes position the upwardly facing valve seat or wafer with the diaphragm thereabove having its lower surface exposed downwardly so as to receive directly the pressure of the viscous fluid product upwardly displaced by squeezing of the squeeze bottle. There is no wall between the diaphragm's lower surface and the product being squeezed upwardly from the squeeze bottle.

The diaphragm is free from restraint other than that its hole's thin conical periphery contacts the thin conical periphery of the wafer forming the valve seat, a stop preventing the two peripheries from wedging together. If the squeeze bottle is squeezed inadvertently, the diaphragm is very free to displace and open its hole's periphery from the wafer's periphery. To prevent such inadvertent discharge of the product, the valve body provides a manual means for closing and positively shutting off the product from the valve seat without rigidly restraining the diaphragm, while preventing the fluid viscous product from flowing to the seat. However, the diaphragm's bottom is always completely exposed to the product in the bottle and the diaphragm can move at all times.

The Laauwe and Roggenburg patented valve must incorporate a vent for venting the squeeze bottle after squeezing because it is air-tight when closed. Consequently, the valve of the present invention has one or more air vent passages, but at the same time has means for opening and closing the vent or vents automatically and simultaneously with opening and closing of the valve means which shuts off the product from the valve seat.

In addition to the above, the present invention provides for non-removably locking the valve on the mouth of the squeeze bottle by the manufacture of the product merchandised in the squeeze bottle. This is to prevent product substitution.

In connection with the following detailed description of the invention, reference is made to the accompanying drawings in which:

FIG. 3 is a vertical cross section showing the cap of the new valve;

FIG. 4 is a bottom view of this cap taken on the line 4—4 in FIG. 3;

FIG. 5 is a vertical section showing the base of the new valve;

FIG. 6 is a plan view of FIG. 5;

FIG. 7 is a vertical section of the valve with its cap and base assembled together and its positive shut-off parts open for normal dispensing valve action;

FIG. 8 is a horizontal cross section taken on the line 8—8 in FIG. 7;

FIG. 9 is like FIG. 7 but showing the parts in the valve shut-off condition;

FIG. 10 is a horizontal cross section taken on the line 10—10 in FIG. 9;

FIG. 13 is an elevation view showing a locking arrangement for preventing unscrewing of the valve when once applied to the mouth of a squeeze bottle, the parts shown in this figure indicating the valve lock-on condition;

FIG. 14 is the same as FIG. 13 but shows the valve as it is screwed on a squeeze bottle mouth;

Familiarity with the Laauwe and Roggenburg patent is assumed in the following description of the details shown by the above drawings.

Figure 1:
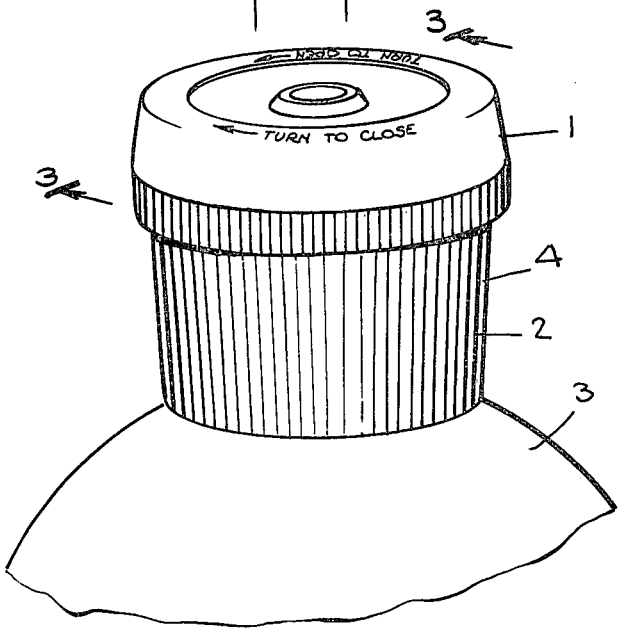
FIG. 1 is a perspective view of the new valve as it is attached to the mouth of a squeeze bottle.
Figure 11:
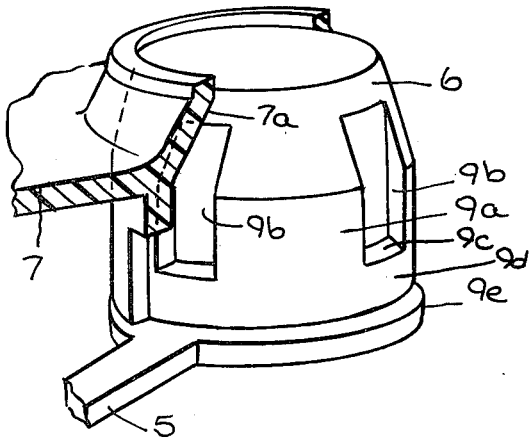
FIG. 11 is a cut-apart perspective view of the valve's shut-off parts in open position.
Figure 2:
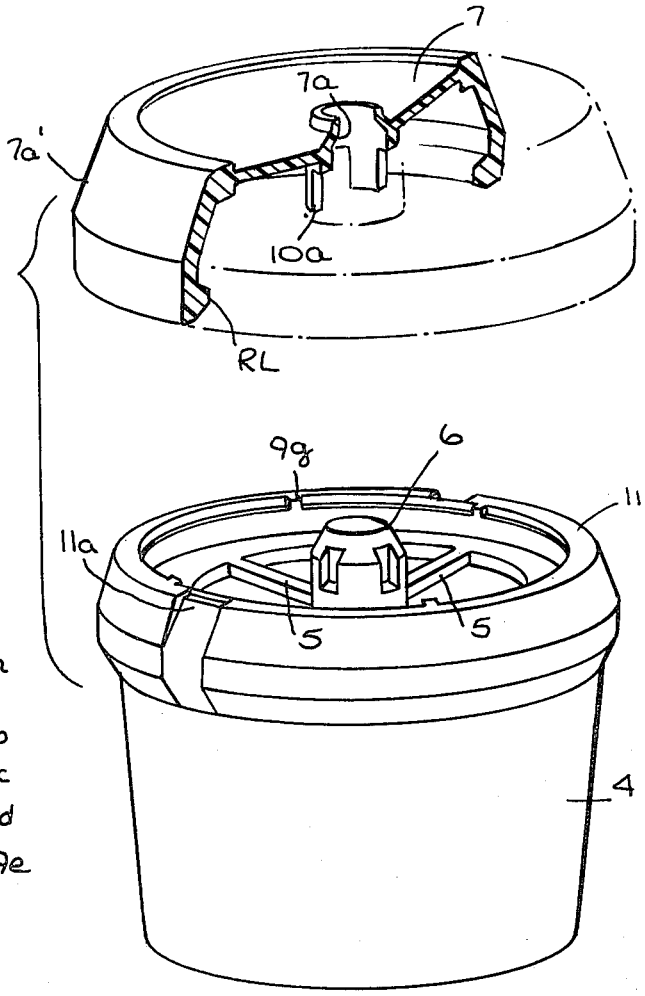
FIG. 2 is an exploded view showing the cap and base parts of the new valve.
Figure 12:
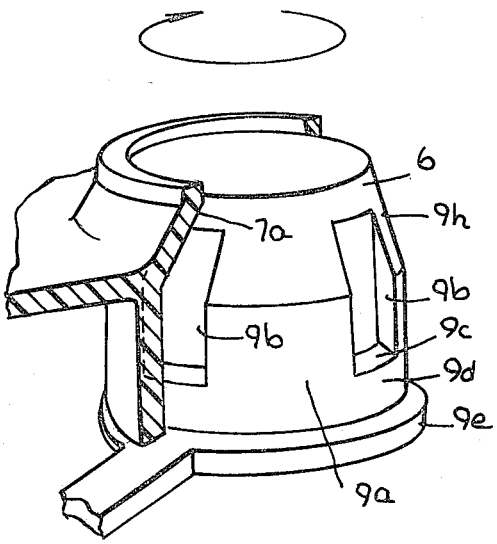
FIG. 12 is the same as FIG. 11 but shows the parts in shut-off position.
Figure 16:
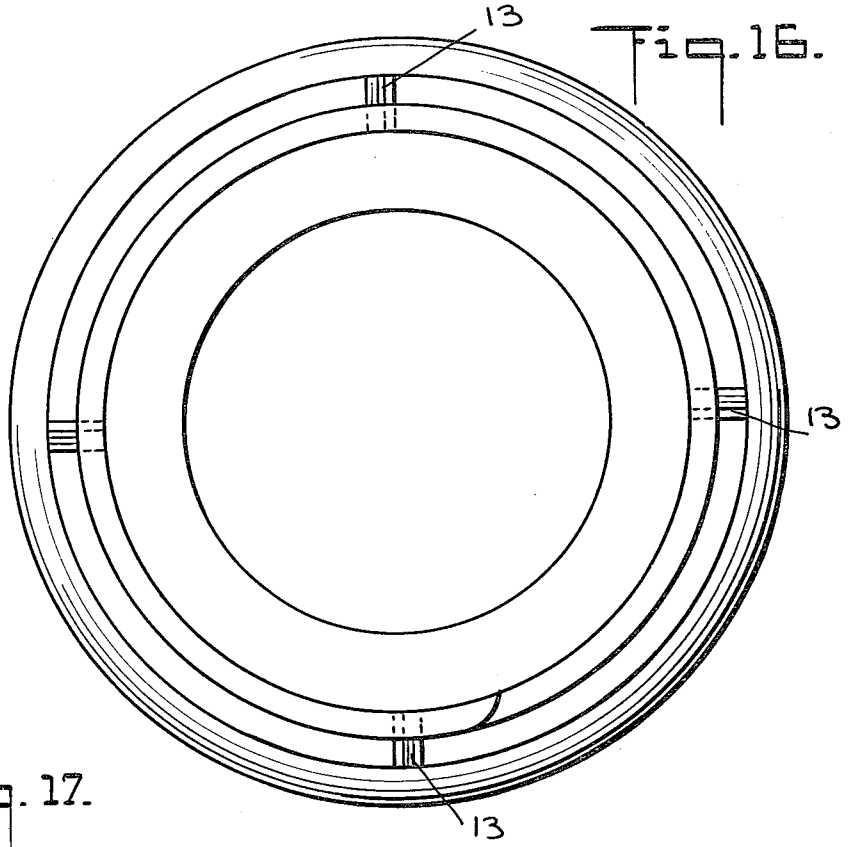
FIG. 16 shows the upper periphery of the squeeze bottle mouth on which the valve is screwed in FIGS. 13 and 14.
Figure 15:
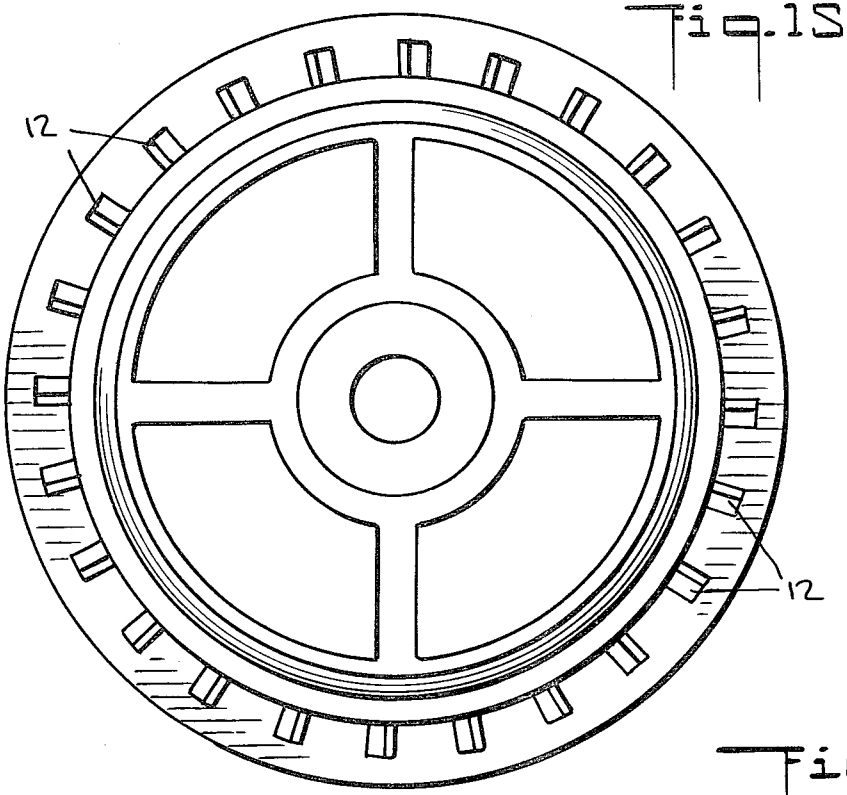
FIG. 15 is a bottom view of the valve shown by FIGS. 13 and 14.
Figure 17:
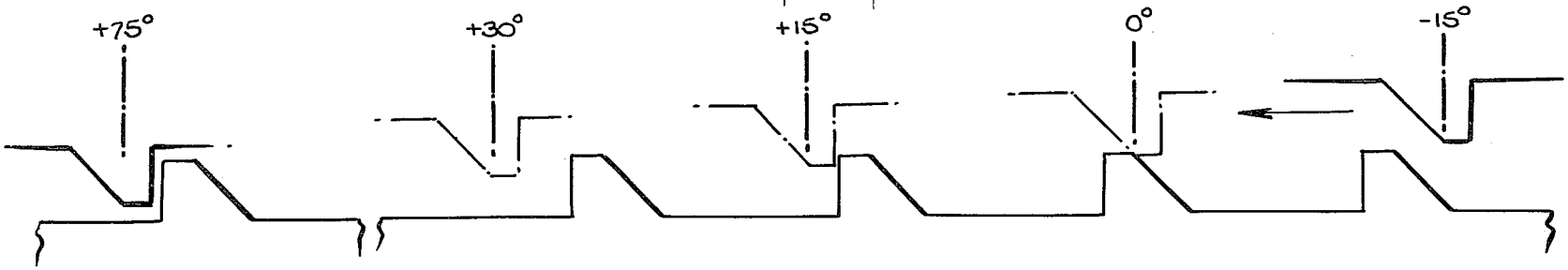
FIG. 17 schematically shows the action involved during the screwing on of the valve for locking it unremovably to the bottle mouth.

FIG. 1 shows the external appearance of the new valve with its rotative cap 1 bearing close and open indicia and its base 2 screwed on the mouth of a squeeze bottle 3. The valve is in the form of an annular body, the cap forming an upper portion and the base forming a lower portion.

The base 2 above its screw-threaded skirt 4 which is screwed on the standard threaded mouth of the squeeze bottle, has above the screw thread **4*a* the spokes 5 that extend radially inwardly and position the upwardly facing valve seat wafer 6. The cap has the upwardly deflectable elastic diaphragm 7 above the spokes and having the hole with its periphery 7*a* normally seating on and mating with the valve seat wafer's periphery as shown by FIGS. 7 and 9 for example. Both peripheries form thin conical surfaces. The lower surface of the diaphragm is exposed downwardly and is completely open downwardly, excepting for the thin spokes, for receiving the pressure of a viscous fluid product when contained by the squeeze bottle and the squeeze bottle is squeezed. This pressure causes upward displacement or springing of the diaphragm and separation of its hole's periphery from that of the valve seat 6**.

The valve means for closing and positively shutting off the viscous product from the valve seat 6 without restraining upward displacement of the diaphragm, or for permitting the product to flow to this seat, depending on whether the cap 1 is turned to close or open position, with the diaphragm being free from rigid restraint at all times, is as follows:

The valve seat 6 is positioned by the inner tips of the spokes 5 via an interposed pedestal 9 upstanding from the spokes and having a cylindrical side **9*a* of larger diameter than the valve seat and the diaphragm's hole. In this cylindrical side four vertically extending passages in the form of longitudinally extending grooves 9*b* lead to the valve seat. The grooves have closed lower ends 9*c*, leaving therebelow a lower ungrooved portion 9*d* of the cylindrical side. The cap's diaphragm has a cylindrical sleeve 10 depending from it around the periphery 7*a* of its hole. This sleeve is telescoped on the cylindrical side of the pedestal so as to be axially and rotatively slidable on this side, and is part of the cap that is now designed to rotate on the base of the valve. This sleeve has four side openings in the form of open-bottom slots 10*a*, each slot extending upwardly to a position above the closed bottom ends 9*c* of the grooves in the pedestal. The grooves and slots are symmetrically positioned so that they can mutually register. Rotation of the cap can turn the sleeve's slots into registration with the pedestal's grooves so that a viscous product squeezed from the squeeze bottle has free access to the valve seat 6 for dispensing of the fluid product, and when the cap is turned so that the sleeve's slots are on the ungrooved portions of the pedestal's side, the grooves 9*b*** are closed by the sleeve's unslotted portions.

In the above way a mutually positive shut-off of the dispensing valve is provided while at the same time the diaphragm's sleeve can slide vertically on the pedestal with the diaphragm to move correspondingly without rigid restraint.

The lower portion **9*d* of the pedestal extends ungrooved upwardly far enough so that the lower portion of the sleeve never uncovers the pedestal's grooves during upward diaphragm motion within the limits of its possible movement. Therefore, the pedestal grooves are always closed when the sleeve is in its closed position. The diaphragm 7 is elastic and following the laws of elasticity, its resistance to displacement rapidly increases with its displacement or strain, assuring that the lower end of the sleeve never leaves the ungrooved portion 9*d*** of the pedestal.

To insure against production problems that might be caused by injection molding the pedestal 9, it is cored out from its bottom so that the pedestal has the appearance of an inverted cup with a thin wall. This reduces substantially the volume of plastic that might otherwise be required by the pedestal when injection molding the base. Also, the valve seat wafer is made thin with a flat bottom 6*a* as well as a flat top, and is supported by the spoke tips via the ungrooved portions of the pedestal, substantially maintaining the advantages of the Laauwe and Roggenburg patent construction.

In other words, the valve seat 6 is essentially the wafer seat of the Laauwe and Roggenburg patent, and the spokes 5 radiate from its bottom, the pedestal grooves 9*b* providing downward clearance for the viscous product when the diaphragm hole's periphery 7*a* closes its equally thin mating surface on the valve seat periphery, when the diaphragm returns from its displacement to its normal seating position, and, of course, the manually controlled positive shut-off valve means is open. To positively prevent downard wedging of the diaphragm hole's periphery on the valve seat, the base of the pedestal is formed with an encircling flange or ring 9*e* which forms a stop below the valve seat wafer's periphery, preventing excessive downward movement of the diaphragm from which the sleeve depends. As in the Laauwe and Roggenburg patent, the valve seat 6 and the hole's periphery 7*a* are both thin mating conical surfaces which substantially contact each other in their entireties when closed together, the ring or flange 9*e* on which the sleeve's bottom end is rotatively slidingly supported insuring this relationship.

To rotatively interconnect the cap and base, the cap has a depending skirt 7*a* which fits over the upper portion of the base, the two being shaped to form a ring lock RL. The cap and base are respectively integral injection-molded plastic parts and for assembly of the valve the cap is pushed onto the base with the ring lock RL snapping into its locked position. The lock is formed by angular surfaces exerting a wedging action which pulls the cap down on the base when the parts are assembled, and the cap is formed with an annular flat surface 7*b* which is then pressed down on a corresponding flat surface 11 on the upstanding rim of the base so that the viscous product cannot escape between the peripheries of the cap and base. However, the surface 7*b* can rotatively slide on surface 11.

For the air venting required for reexpansion of the squeeze bottle after squeezing, the base's rim surface 11 is formed with at least one or more, preferably two, radial grooves 11*a*, each groove being radially aligned with one of the grooves 9*b* in the pedestal's side. In each case, this forms a venting passage extending to the outside of the valve, the ring lock RL permitting the passage of air because it inherently cannot be made airtight. The cross-sectional area of each venting groove 11*a* is proportioned so that with its top closed by the cap surface 7*b*, normal squeezing of the squeeze bottle cannot force the viscous product through the venting passage due to the product's flow resistance, but when the bottle is released, air with its much lower viscosity, can be sucked back into the bottle for venting. However, when the manual positive shut-off is closed and the bottle is packed under constant pressure in a suitcase, for example, the product can under the constant pressure ooze through any such venting passage.

To prevent the above, the cap has for each of the venting passage grooves 11*a* a depending tab closure 7*c* which rotatively slides in an annular groove 9*f* formed in the base inwardly of the rim surface 11 on which the surface 7*b* of the cap rides, each tab closure 7*c* being positioned radially opposite a solid or unslotted portion of the cap's sleeve 10. When the cap is turned to its positively closed or shut-off position, the tab 7*c* also positively shuts off the venting passage 11*a* for which it is intended. The groove 9*f* is provided with stops 9*g* positioned so as to be engaged by the tab closure or closures 7*c* and in such a manner as to limit the rotation of the cap to its closed and opened positions.

To accommodate the difference in diameter between the valve seat 6 and the larger diameter of the pedestal 9, the upper portion of the pedestal forms a conical male portion between the seat 6 and the pedestal's cylindrical side 9*a*, and the grooves 9*b* extend vertically in this male portion to the seat's periphery. The upper tip of this male portion, above the top ends of the grooves, forms the axially thin conical seat 6. The male portion and the seat have the same conical angularity.

The diaphragm is formed with a conical female portion separably fitting the male portion and extending coextensively therewith from the diaphragm hole's periphery 7*a* to the base of the conical male portion where the female portion forms a junction with the diaphragm's sleeve, from which junction the diaphragm extends radially.

With the above construction, when this new valve is in its open position by rotation of its cap, the periphery of the valve seat is extensively open downwardly via the groove 9*b* and slots 10*a*.

When the manual positive shut-off parts are in their open position, the operation of the valve is essentially the same as described by the Laauwe and Roggenburg patent. The entire bottom of the diaphragm is open to receive the pressure of the viscous product squeezed from the squeeze bottle, and when squeezing is terminated, the thin conical mating valve surfaces freely close because there is nothing to prevent free flow of the product from them, there being no substantial obstruction in the downward direction because of the multiplicity of grooves in the pedestal's side. The stop or ring 9*e* assures proper complete mating of the conical valve surfaces without any wedging action between them. When the cap is turned to its closed position, any possible flow of the product is positively prevented from reaching the valve seat with consequent inadvertent extrusion, while simultaneously the venting passage or passages are also shut off. A positive manual and complete shut-off is provided.

At the same time the two parts of this new valve can be injection-molded in the large quantities required, without production problems. The pedestal is cored out so that it is of small volume with thin cross sections, and can be held to the precision concentricity with the diaphragm hole required for the complete mating of the conical valve surfaces, when the parts are injection molded. This also applies to the pedestal side and the diaphragm's sleeve which if asymmetric would jam and restrain the diaphragm's free motion.

The manufacturers of some viscous products have indicated a desire for a non-refillable squeeze bottle. To meet this requirement as shown by FIGS. 13–17, this new valve can have the bottom of its base provided with an annular series of ratchet teeth 12, with the mouth of the bottle provided with one or more upstanding ratchet teeth 13 pointing in a direction opposite to that of the teeth 12. The direction in which the teeth interlock to prevent reverse motion should be opposite to the screwing direction required to apply the valve to the bottle, the standard squeeze bottle having a right-hand thread. As the cap is screwed on the bottle, the action illustrated by FIG. 17 occurs, ultimately arriving at the condition shown by FIG. 13 with the valve unremovably locked on the bottle.

Because of the right-hand bottle mouth thread, it is preferable to design the new valve so that the cap turns to its closed direction with a right-hand rotation. The valves are applied by automated machinery which screw the valves on one bottle after another, and with the cap turning in the screwing direction to its closed position, all bottles are produced with the valves in their positive shut-off condition which is a shipping advantage.

I claim:

1. A self-closing squeeze bottle dispensing valve comprising an annular body having a lower portion adapted for connection with the bottle's mouth and above said portion spokes that extend from the body radially inwardly and position an upwardly facing valve seat, said body having an upper portion having an upwardly deflectable elastic diaphragm above the spokes, said elastic diaphragm having a hole with a periphery normally seating on the valve seat and a lower surface exposed to and receiving the pressure of fluid upwardly displaced by squeezing the bottle when the latter contains a fluid product, said pressure causing upward displacement of the diaphragm and separation of said periphery from said seat, said body including valve means having an open and a closed position, said valve means in said open position permitting upward displacement of the diaphragm by said fluid pressure and allowing product to flow to the periphery of said hole, said valve means in said closed position permitting upward displacement of the diaphragm by said fluid pressure but preventing the product from flowing to the periphery of said hole, the diaphragm's said displacement being free from rigid restraint at all times.

2. The valve of claim 1 in which said valve means comprises said valve seat being positioned by said spokes on an interposed pedestal upstanding from the spokes and having a cylindrical side of larger diameter than the valve seat and the diaphragm's said hole and having at least one vertically extending passage leading to the valve seat and opening through said side, and said diaphragm has a cylindrical sleeve depending therefrom around said periphery of the diaphragm's said hole and telescoped on said cylindrical side of the pedestal so as to be axially and rotatively slidable on said side, the body's said upper portion being rotative relative to its said lower portion so as to cause rotation of the sleeve relative to the pedestal by rotation of the upper portion, and said sleeve closing said passage when the body's said upper portion is turned to said valve means closed position and having a side opening that registers with said opening of the pedestal when said upper portion is turned to said valve means open position, said sleeve sliding axially on the pedestal and free from restraint to the diaphragm's said displacement.

3. The valve of claim 2 in which the pedestal's said passage is in the form of a longitudinally extending groove in said cylindrical side, the groove having a closed lower end leaving therebelow a lower portion of the cylindrical side and the bottom end portion of said sleeve sliding thereon within the limits of the diaphragm's said displacement and the groove extending upwardly so as to open at the periphery of said valve seat, the sleeve's said side opening being formed by an open-bottomed slot extending upwardly to a position above the groove's said closed bottom end portion.

4. The valve of claim 3 in which the pedestal has a flange below the sleeve's said open-bottomed slot and positioned so as to be abutted by the bottom end of the sleeve when the diaphragm hole's said periphery is seated on said valve seat.

5. The valve of claim 4 in which the upper portion of the pedestal forms a conical male portion between said valve seat and the pedestal's said cylindrical side and said groove extends vertically in this male portion to the seat, said diaphragm having a conical female portion separably fitting said male portion and extending coextensively therewith from the diaphragm's said hole to the base of the conical male portion and to a junction with the diaphragm'said sleeve and from which the diaphragm then extends radially.

6. The valve of claim 1 in which the annular body's said upper portion is rotatively connected to its said lower portion and the upper portion is connected to said valve means for actuation of the latter by rotation of the upper portion, said body having at least one air vent passage formed by a radial groove through the periphery of one of its said upper and lower portions and means for closing the vent when the upper body portion is rotated to a position actuating said valve means so as to close the same, and for opening said air vent passage when the upper body portion is rotated to a position actuating said valve means so as to open the same.

* * * * *